US006543231B2

(12) United States Patent
Stuttaford et al.

(10) Patent No.: US 6,543,231 B2
(45) Date of Patent: Apr. 8, 2003

(54) CYCLONE COMBUSTOR

(75) Inventors: Peter John Stuttaford, Toronto (CA); Aleksandar Kojovic, Oakville (CA)

(73) Assignee: Pratt & Whitney Canada Corp, Quebec (CA)

( * ) Notice: Subject to any disclaimer, the term of this patent is extended or adjusted under 35 U.S.C. 154(b) by 0 days.

(21) Appl. No.: 09/903,636

(22) Filed: Jul. 13, 2001

(65) Prior Publication Data

US 2003/0010031 A1 Jan. 16, 2003

(51) Int. Cl.[7] ..... F02C 3/00
(52) U.S. Cl. ..... 60/737; 60/39.37
(58) Field of Search ..... 60/737, 39.37

(56) References Cited

U.S. PATENT DOCUMENTS

| | | | | |
|---|---|---|---|---|
| 297,549 A | | 4/1884 | Ackermann et al. | |
| 2,411,663 A | | 11/1946 | McCollum | |
| 2,579,614 A | | 12/1951 | Ray | |
| 2,797,549 A | | 7/1957 | Probert et al. | |
| 2,828,608 A | | 4/1958 | Cowlin et al. | |
| 4,891,936 A | | 1/1990 | Shekleton et al. | |
| 4,928,481 A | * | 5/1990 | Joshi et al. | 60/737 |
| 4,936,090 A | | 6/1990 | Shekleton | |
| 4,967,563 A | | 11/1990 | Shekleton | |
| 5,214,911 A | | 6/1993 | Shekleton | |
| 5,277,022 A | | 1/1994 | Shekleton et al. | |
| 5,450,724 A | * | 9/1995 | Kessell et al. | 60/737 |
| 5,477,671 A | * | 12/1995 | Mowill | 60/39.23 |
| 5,479,781 A | | 1/1996 | Fric et al. | |
| 5,596,873 A | | 1/1997 | Joshi et al. | |
| 5,628,192 A | * | 5/1997 | Hayes-Bradley et al. | 60/733 |
| 5,850,732 A | | 12/1998 | Willis et al. | |
| 6,250,066 B1 | * | 6/2001 | Lawrence et al. | 60/39.23 |

FOREIGN PATENT DOCUMENTS

| | | |
|---|---|---|
| EP | 0731316 | 9/1996 |
| EP | 0773410 | 5/1997 |

* cited by examiner

*Primary Examiner*—Ehud Gartenberg
(74) *Attorney, Agent, or Firm*—Todd D. Bailey

(57) ABSTRACT

A cyclone combustor of the present invention uses a novel pre-mixture injection scheme to optimize performance. The cyclone combustor includes a cylindrical combustor can and three fuel/air premixing tubes entering the combustor can radially, with a tangential offset. The tangential offset is designed to provide an optimized circulation in the combustor can for improvement of liner life span, flame stability and engine turn-down. The ignition and pilot fuel systems are placed to take advantage of the premixing tube entry locations and the tangential direction of the mixture flow momentum in the combustor can. The special combination of the parallel axes of the combustor can and the mixing tubes provides a right angle between an outlet section and the major tube section of each premixing tube. The cyclone combustor of the present invention can meet the requirements for low $NO_x$ and CO emissions.

7 Claims, 1 Drawing Sheet

CYCLONE COMBUSTOR

FIELD OF THE INVENTION

The present invention relates to gas turbine engines, especially to a gas turbine combustion system, and more particularly to a cyclone combustor which has premixed fuel/air mixture tangentially injected into the combustor.

BACKGROUND OF THE INVENTION

Industrial gas turbine engines must operate under increasingly stringent emissions requirements. In order to have a marketable power generation product, an engine producing the lowest possible emissions is crucial. Emissions of nitrogen oxides $NO_x$ and carbon monoxide (CO) must be minimized over specified engine operating ranges. To achieve this low level of emissions the combustion system requires the complete burning of fuel and air at low temperatures.

The current technologies for achieving lower $NO_x$ may require fuel and air to be premixed before entering the combustor. Combustors that achieve lower $NO_x$ emissions without water injection are known as dry-low-emissions (DLE) and offer the prospect of clean emissions combined with high engine efficiency. This technology relies on a high air content in the fuel/air mixture.

In a DLE system, fuel and air are lean-premixed prior to injection into the combustor. However, two problems have been observed. The first is combustion instability or unstable engine operability which results in noise, and the second is the related CO emissions. The stability of the combustion process rapidly decreases at lean conditions and the combustor may be operating close to its blow-out limit because of the exponential temperature dependence of the chemical reactions. This can also lead to local combustion instabilities which change the dynamic behaviour of the combustion process, and endanger the chemical integrity of the entire gas turbine engine. This is because several constraints are imposed on the homogeneity of the fuel/air mixture since leaner than average pockets of mixture may lead to combustion stability problems, and richer than average pockets will lead to unacceptably high $NO_x$ emissions. At the same time, a substantial increase in CO and unburned hydrocarbon (UHC) emissions as a tracer for combustion efficiency is observed, which is due to the exponential decrease in chemical reaction kinetics at leaner mixtures for a given combustor. Therefore, efforts have been made in development of novel fuel mixing and burning devices.

It is well known that in general, injection of fuel/air mixtures tangentially into the combustor will provide optimum circulation of fuel/air mixture in the combustor to improve combustor life span and flame stability. An example of a cyclone or vortex type combustion chamber is described in U.S. Pat. No. 2,797,549 to Probert et al. on Jul. 2, 1957. The cyclone or vortex type combustion chamber described by Probert et al. includes three fuel premixing chambers tangentially oriented with respect to the combustion chamber. Incoming air is directed into the tangential premixing chambers and is mixed with the fuel supply therein before being injected into the helical vortex of the combustion chamber.

Nevertheless, the fuel/air mixture is generally flammable so that undesirable flashback into the premixer section is possible. Furthermore, gas turbine combustors utilizing lean premixed combustion typically require some conversion from a premixed to a non-premixed (diffusion) operation at turn-down conditions, to maintain a stable flame. Such conversion capability introduces undesirable design complexities and generally raise costs. The disadvantages of premixing have been recognized in the industry and therefore there is a need for new combustion systems using a premixed fuel/air mixture to overcome these problems.

SUMMARY OF THE INVENTION

One object of the present invention is to provide a cyclone combustor for a gas turbine engine which provides an optimized circulation of a premixed fuel/air mixture in the combustor.

Another object of the present invention is to provide a combustor using a premixed fuel/air mixture while inhibiting undesirable flashback into the premixer section.

In accordance with one aspect of the present invention, a combustor is provided for a gas turbine engine which comprises a substantial cylindrical combustor can and a plurality of fuel and air premixing tubes. The combustor can has a central axis and includes an upstream end wall and a continuous side wall around the central axis thereof for receiving fuel and air to produce combustion products for the engine. The respective premixing tubes are attached to the side wall of the combustor can and are in fluid communication with the combustor can. The premixing tubes are positioned adjacent to the upstream end wall and are circumferentially spaced apart from one another. Each of the premixing tubes includes a major tube section for producing a fuel/air mixture therein and an outlet section for injecting the fuel/air mixture into the combustor can for combustion. The major tube section has a central axis thereof parallel to the central axis of the combustor can, and the outlet tube section has a central axis thereof extending substantially perpendicularly to the central axis of the major tube section and being oriented toward the combustor can radially, with a tangential offset.

The tangential offset of each premixing tube with respect to the combustor can is determined with a parameter T, preferably $\frac{1}{24}T<T<\frac{1}{6}D$ wherein D is the length of a diameter of the combustor can and T is the distance between the central outlet section axis of the premixing tube and a diametrical line of the combustor can, the diametrical line being parallel to the central outlet section axis. It is preferable that at least one of the premixing tubes is adapted to be individually staged, producing the fuel/air mixture with a selected mixing ratio, or delivering pure air.

The cyclone combustor of the present invention uses a novel premixer scheme to optimize performance. The tangential offset of the premixing tubes is designed to provide an optimized circulation in the combustor can for liner life span, flame stability and engine turn-down operation which requires a minimum flameout fuel/air ratio, as well as for low combustion noise and low emission levels. The ignition and pilot fuel system is placed to take advantage of the premixing tube entry locations as well as the direction of mixture flow momentum. Furthermore, the specific combination of parallel axes of the fuel combustor can and the premixing tubes provides a right angle between the outlet section and the major tube section of each premixing tube such that flashback into the premixing tube is effectively inhibited.

The cyclone combustor of the present invention is able to meet the current requirements for emissions, i.e. $NO_x$ emissions lower than 10 ppm and CO emissions lower than 10 ppm.

Other advantages and features of the present invention will be better understood with reference to a preferred embodiment of the present invention described hereinafter.

BRIEF DESCRIPTION OF DRAWINGS

Having thus generally described the nature of the present invention, reference will now be made to the accompanying drawings by way of example, showing a preferred embodiment, in which.

DETAILED DESCRIPTION OF THE PREFERRED EMBODIMENT

Figure 1:
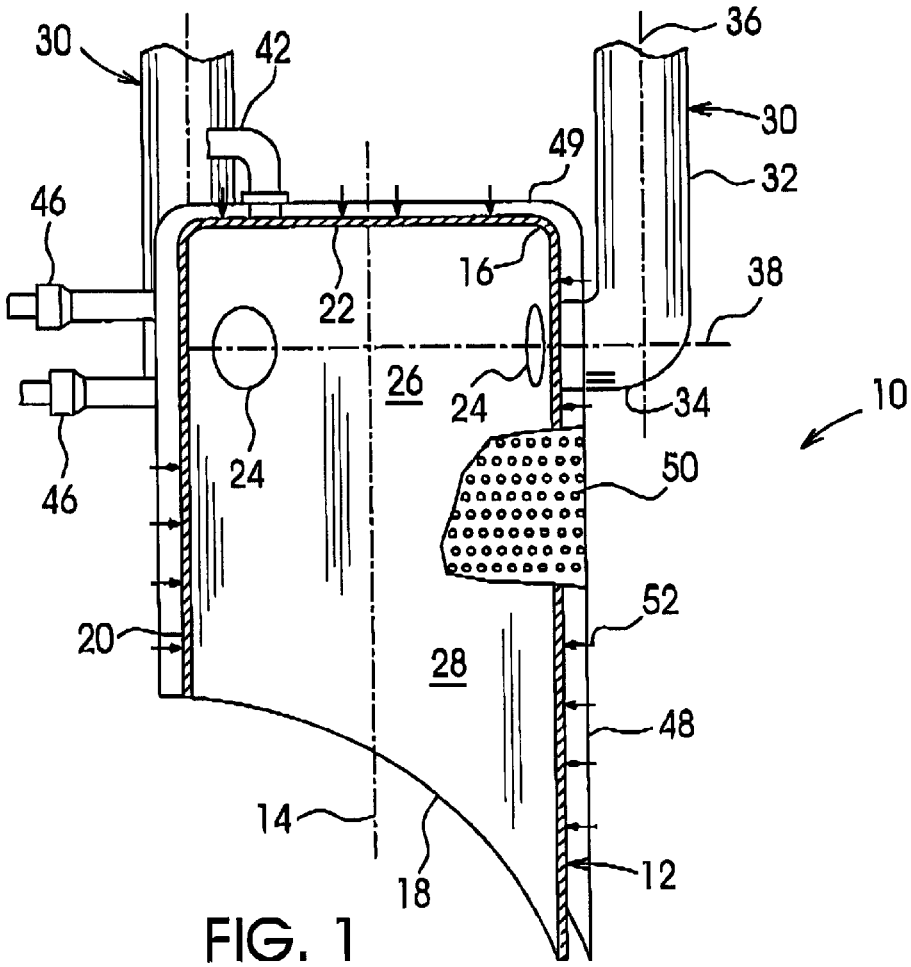
FIG. 1 is a cross-sectional view of a gas turbine combustor incorporated with a preferred embodiment of the present invention with a section of the side view thereof showing the holes in an impingement skin of the combustor.

A cyclone combustor of the present invention is illustrated in the drawings and indicated generally at numeral 10. The cyclone combustor 10 includes a cylindrical combustor can 12 having a central axis 14, an upstream end 16 and a downstream end 18 defined by an annular side wall 20. The upstream end 16 is closed by an upstream end wall 22 and the downstream end 18 is in fluid communication with a turbine section of the engine (not shown). Three entry openings 24 (only two are shown) are provided in the annular side wall 20 adjacent to the upstream end wall 22 for receiving premixed fuel/air mixture into the combustor can 12. The combustion processing of the premixed fuel/air mixture takes place generally in a primary combustion zone 26 which is defined within an upstream section of the combustor can 12. The combustion products generated within the primary combustion zone 26 as well as the unreacted fuel and air will complete the combustion process in a secondary combustion zone 28 which is a section of the combustor can 12 downstream of the primary combustion zone 26. The final combustion products are then discharged from the downstream end 18 into the combustor transition duct.

Three fuel and air premixing tubes 30, such as venturi premixing tubes, are attached to the side wall 20 of the combustor can 12 and are positioned adjacent to the upstream end wall 22. The premixing tubes 30 are circumferentially, equally spaced apart from one another and are in fluid communication with the combustor can 12 through the respective entry openings 24 in the side wall 20.

Each premixing tube 30 includes a major tube section 32 for producing the fuel/air mixture therein and an outlet section 34 for injecting the fuel/air mixture into the combustor can 12 for combustion. The major tube section 32 has a central axis 36 thereof extending substantially parallel to the central axis 14 of the combustor can 12. The outlet section 34 has a central axis 38 thereof extending substantially perpendicular to the central axis 36 of the major tube section 32 and is oriented toward the combustor can 12 radially with a tangential offset as indicated by T.

The tangential offset T of each premixing tube 30 with respect to the combustor can 12 is a distance between the central outlet axis 38 of the premixing tube 30 and the diametrical line 40 of the combustor can 12, the diametrical line 40 being parallel to the central outlet section axis 38. The tangential offset T is smaller than ⅙ of the length D of the diameter of the combustor can 12 and is greater than $1/24$ of the length D of the diameter. Preferably T is equal to $1/12$ of D. Thus, the fuel/air mixture flows injected from the respective entry openings 24 in the side wall create a swirling helical pattern within the primary combustion zone 26 of the combustor can 12 as a result of the tangential offset of the fuel/air mixture flows exiting from the outlet sections 34 of the premixing tubes 30, respectively. The swirling helical pattern of the burning fuel/air mixture in the primary combustion zone 26 provides optimum circulation in the combustor can 12 which improves the liner life span of the combustor can 12, flame stability in the combustion process and engine turn-down, as well as the reduction of combustion noise and emission levels.

In order to enhance flame stability it is important that hot combustion products re-circulate in the primary combustion zone 26 of the combustor can 12. The residence time of these products of combustion in the primary combustion zone 26 is controlled by the offset of the premixing tubes 30, thus controlling stability and emissions.

The determination of the tangential offset T, therefore, is a balance between the need for both flame stability and improved liner life span. When the tangential offset T is greater, the swirling helical burning fuel/air mixture flow is stronger and closer to the side wall 20 of the combustor can 12, which benefits flame stability while exposing the side wall 20 to higher temperatures and thereby reducing the liner life span of the combustor can 12. On the other hand, when the tangential offset T is smaller the swirling helical burning fuel/air mixture flow is weaker and closer to the central line 14 of the combustor can 12, which keeps the side wall 20 of the combustor can 12 at comparatively lower temperatures, thereby improving the liner life span of the combustor can 12. However, it is apparent that a weak swirling helical pattern of the burning fuel/air mixture flow in the combustor can 12 will reduce flame stability.

The premixing tube is sized to inhibit flashback. By ensuring that the right angle is made with a cylindrical tube which has a substantially constant cross-section, flashback criteria are compromised, since the flow in the tube does not separate.

Figure 2:
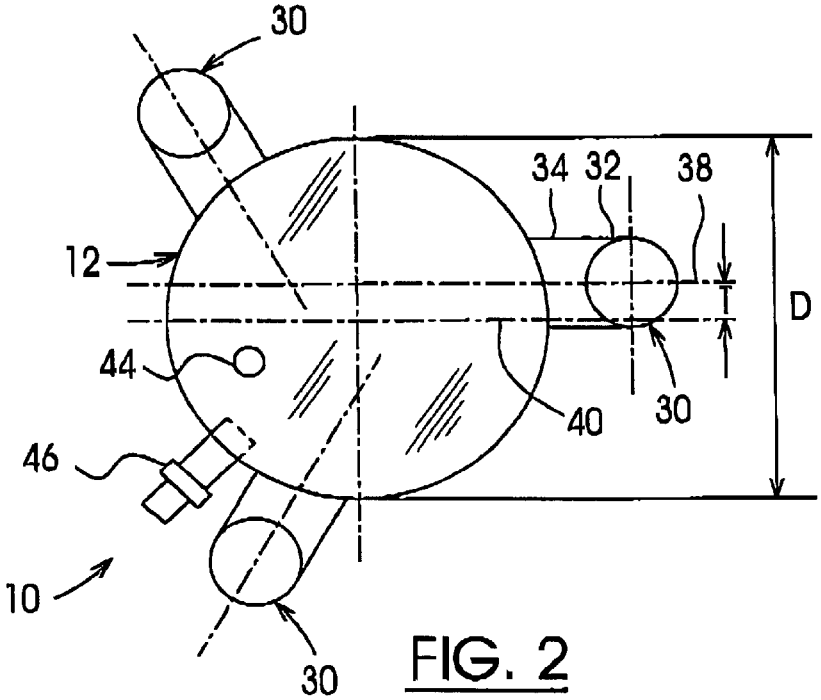
FIG. 2 is top plan view of the embodiment of FIG. 1 showing the tangential offsets of the premixing tubes with respect to the combustor can, the impingement cooling skin and the pilot fuel lines being removed for better illustration.

One pilot fuel line 42 is connected to inlet 44 in the upstream end wall 22 of the combustor can 12, The inlet 44 is positioned substantially between longitudinal planes in which the respective central outlet section axes 38 of premixing tubes 30 also extend. Two igniters 46 are attached to the side wall 20 of the combustor can 12 adjacent to the upstream end wall 22 thereof. Both the igniters 46 are positioned inside the combustor can 12, as illustrated with the broken lines of the end section of igniter 46 in FIG. 2. The igniters 46 are positioned between the inlet 44 and an adjacent premixing tube 30, circumferentially downstream of the inlet 44. The position of the inlet 44 and igniters 46 are clearly illustrated in FIG. 2. Thus, the ignition and pilot fuel system is placed to take advantage of the locations of the entry openings 24 and the tangential direction of the fuel/air mixture flow momentum generated from the tangential offset of the premixing tubes 30.

The cyclone combustor 10 further includes a wrap-around sheet metal skin 48 with perforations 50 therein to form a combustor impingement cooling skin positioned around the annular side wall 20 of the combustor can 12 and radially spaced apart therefrom. The impingement cooling skin is well known and therefore no further details will be described herein. It is optional that the impingement cooling skin 48 includes a perforated end skin 49 positioned axially spaced apart from the upstream end wall 22 of the combustor can 12. Compressed air injects into the perforations 50 of the skin 48 and 49, impinging upon the side wall 20 and the upstream end wall 22 to remove heat from the combustor walls (liners). The combustor walls of the cyclone combustor 10 according to the present invention, at least the upstream section defining the primary combustion zone 26, are cooled only by impingement air. The combustion reaction will not be quenched in the wall region and the CO emissions remain low because no cooling air is directly introduced into the combustor can 12, primarily the combustion zone 26.

The three premixing tubes 30 are individually controllable, and are adapted to produce the fuel/air mixture in a pre-selected mixing ratio, or to deliver pure air. In operation, one of the premixing tubes 30 may perform as a stage one mixer and the other two as a stage two premixers so that without changing a total air mass flow, a richer fuel mixture can be injected into the combustor can 12 from the stage one premixing tube, for example, and pure compressed air may be injected from the other two premixing tubes 30 in an engine operating mission when power is the major concern and achieving the targeted emission levels is of less concern.

Modifications and improvements to the above-described embodiment of the present invention may become apparent to those skilled in the art. The foregoing description is intended to be exemplary rather than limiting. The scope of the invention is therefore intended to be limited solely by the scope of the appended claims.

We claim:

1. A combustor for a gas turbine engine comprising:

a substantially cylindrical combustor can having a central axis, including a upstream end wall and a continuous side wall around the central axis thereof for receiving fuel and air to produce combustion products for the engine;

a plurality of fuel and air premixing tubes in fluid communication with the combustor can, the premixing tubes being attached to the side wall of the combustor can, adjacent to the upstream end wall and being circumferentially space apart from one another; and each of the premixing tubes including a major tube section for producing a fuel/air mixture therein and an outlet section for injecting the fuel/air mixture into the combustor can for combustion, the major tube section having a central axis thereof substantially parallel to the central axis of the combustor can, and the outlet section having a central axis thereof extending substantially perpendicularly to the central axis of the major tube section and being oriented toward the combustor can radially with a tangential offset.

2. The combustor as claimed in claim 1 wherein the tangential offset of each premixing tube with respect to the combustor can is determined by a parameter T greater than $1/24$ D and smaller than $1/6$ D, wherein D is the length of a diameter of the combustor can and T is a distance between the central outlet section axis of the premixing tube and a diametrical line of the combustor can, the diametrical line being parallel to the central outlet section axis.

3. The combustor as claimed in claim 2 wherein T is equal to $1/12$ D.

4. The combustor as claimed in claim 1 wherein at least one of the premixing tubes is adapted to be individually staged, producing the fuel/air mixture with a selected mixing ratio, or delivering pure air.

5. The combustor as claimed in claim 1 further comprising at least one pilot fuel line connected to an inlet in the upstream end wall of the combustor can and positioned substantially between longitudinal planes in which the respective central outlet section axes of the premixing tubes extend.

6. The combustor as claimed in claim 5 further comprising at least one igniter attached to the side wall of the combustor can adjacent to the upstream end wall thereof, the igniter being positioned inside the combustor can between the pilot inlet and an adjacent premixing tube, circumferentially downstream of the pilot inlet.

7. The combustor as claimed in claim 1 wherein an upstream section of the combustor can defining a primary combustion zone therein is cooled only by impingement air.

* * * * *